United States Patent [19]

Tamary

[11] Patent Number: 4,614,560

[45] Date of Patent: Sep. 30, 1986

[54] PNEUMATIC ADHESIVE CONTROL SYSTEM

[75] Inventor: Ernest J. Tamary, Rochester, N.Y.

[73] Assignee: Eastman Kodak Company, Rochester, N.Y.

[21] Appl. No.: 726,192

[22] Filed: Apr. 22, 1985

[51] Int. Cl.[4] ..... B05B 1/00

[52] U.S. Cl. ..... 156/357; 118/684; 137/83

[58] Field of Search ..... 156/356, 357; 118/684, 118/685; 73/37.7; 137/83; 271/260–261; 226/22

[56] References Cited

U.S. PATENT DOCUMENTS

| | | | |
|---|---|---|---|
| 3,159,170 | 12/1964 | Callan | 226/22 X |
| 3,348,519 | 10/1967 | Dyess et al. | 118/684 X |
| 3,742,899 | 7/1973 | Alperin et al. | 118/685 |
| 3,939,482 | 2/1976 | Cotter . | |
| 4,104,983 | 8/1978 | Carstedt | 156/357 X |
| 4,164,001 | 8/1979 | Patnaude | 118/684 |
| 4,389,971 | 6/1983 | Schmidt | 118/684 X |
| 4,406,247 | 9/1983 | Baughman et al. | 118/684 |
| 4,431,690 | 2/1984 | Matt et al. | 118/683 X |
| 4,473,425 | 9/1984 | Baughman et al. | 156/356 |

*Primary Examiner*—David Simmons

*Attorney, Agent, or Firm*—G. Herman Childress

[57] ABSTRACT

An adhesive applicator receives liquid adhesive from an adhesive supply and has a pneumatically operated valve for controlling the flow of adhesive through the applicator to a sheet driven along a path past the applicator. A pneumatic proximity switch is located along the path for sensing the sheet as it approaches the applicator. Air from a pressure amplifier is provided to the pneumatically operated control valve of the applicator in response to the proximity switch sensing the presence of a sheet along the path. The proximity switch also can be connected to a pneumatically operated electrical switch that provides a signal to a logic and control unit for indicating to a machine operator that a paper jam exists in the event the sheet does not clear the proximity switch within a predetermined time interval.

5 Claims, 2 Drawing Figures

PNEUMATIC ADHESIVE CONTROL SYSTEM

BACKGROUND OF THE INVENTION

The present invention relates to a pneumatic system for controlling the application of liquid adhesive to sheets driven past an applicator and, more specifically, to such a system for an adhesive binder.

Commonly assigned U.S. Pat. No. 4,406,247, issued Sept. 27, 1983 in the names of R. C. Baughman et al and entitled "Adhesive Dispensing System" discloses an adhesive applicator having a nozzle through which liquid adhesive is dispensed onto sheets as the sheets are driven seriatim past the nozzle. The sheets are assembled one above another and pressed together in the area of the adhesive in order to form bound booklets. Sheets driven toward the applicator are detected by a light emitter and optical detector, and the resulting signal is provided to a logic and control unit of the binder. The logic and control unit, in turn, activates a solenoid controlled valve in the applicator to turn the applicator on just before the leading edge of a sheet reaches the applicator nozzle and to turn the applicator off just after the trailing edge of the sheet passes the nozzle. In this manner, a continuous stripe of adhesive is applied to one surface of the sheet.

While the apparatus disclosed in U.S. Pat. No. 4,406,247 works satisfactory for its intended purpose, there are several disadvantages to the apparatus. First of all, the time required for it to operate may be longer than desired under certain circumstances. More specifically, the sheets may be traveling at a relatively high speed, for example, approximately 85 inches per second, while the clock function of the logic and control unit may be relatively slow. Thus if the LCU does not provide timely signals to the applicator valve, adhesive may not flow during the time interval required to provide a continuous stripe of adhesive to the full length of a sheet passing beneath the applicator. Also, an electrically energized system of that type may occasionally respond to stray "noise" signals and turn the applicator valve on or off.

Another difficulty with the adhesive dispensing system disclosed in U.S. Pat. No. 4,406,247 is that the adhesive in the applicator may bleed past fluid seals in the applicator and contaminate the solenoid used for operating the applicator. Such can disable the applicator or cause it to function improperly.

A still further disadvantage of the prior system described in such patent is that it may operate with infrared sensors for detecting the movement of sheets toward the adhesive applicator. Such sensors tend to get dirty, and a dirty sensor can cause a shift in the response time of the system. Also, optical sensors may respond to stray light from a source other than the associated emitter, and they may fail to detect transparencies.

SUMMARY OF THE INVENTION

It is an object of the present invention to provide an adhesive control system which is independent of the clock of a logic and control unit, and which is extremely fast in response to sensing of the sheet approaching the adhesive applicator. Another object of the invention is to provide an adhesive control system which is not subject to malfunction from electrical "noise", and to such a system wherein the adhesive dispensing function is substantially isolated from electronics. A still further object of the invention is to provide an adhesive dispensing system which is not subject to contamination from liquid adhesive leaking through seals or the like, and to provide such a system which is self-cleaning and not subject to errors caused by an infrared sensor becoming dirty, responding to a stray light source or failing to detect a transparency.

In accordance with the present invention, a pneumatic system is provided for controlling the flow of adhesive from an applicator to a sheet driven along a path leading past the applicator. The system includes a pneumatic proximity switch located along the path for sensing a sheet as it approaches the applicator. The applicator has an inlet port for receiving adhesive from an adhesive supply and a pneumatically operated valve for controlling the flow of adhesive through the applicator to a sheet. Means responsive to the proximity switch sensing a sheet in the path actuates the valve in the applicator to thereby apply adhesive to the sheet.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The present invention is particularly useful with apparatus as disclosed in commonly assigned U.S. Pat. No. 4,473,425, issued Sept. 25, 1984, in the names of R. C. Baughman et al and entitled "Binding Apparatus and Method." The present invention can be used in lieu of or as a modification of the apparatus disclosed in commonly assigned U.S. Pat. No. 4,406,247, issued Sept. 27, 1983, in the names of R. C. Baughman et al and entitled "Adhesive Dispensing System." In order to avoid unnecessary duplication of description, the disclosures in U.S. Pat. Nos. 4,473,425 and 4,406,247 are hereby incorporated by reference.

Figure 1:
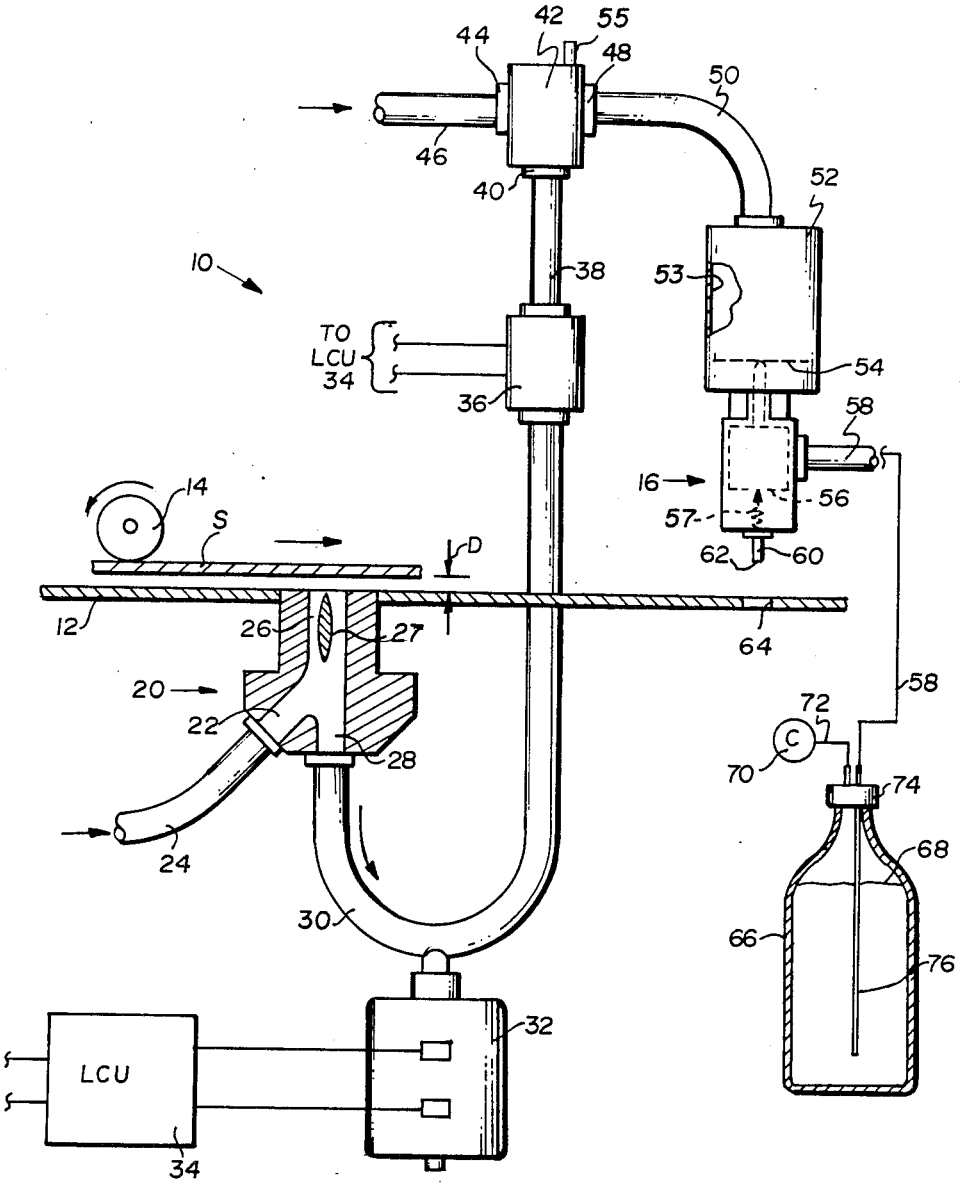
FIG. 1 is a schematic view illustrating a preferred embodiment of a pneumatic adhesive control system of the present invention.

Referring now to FIG. 1 of the drawings, a preferred embodiment of the pneumatic adhesive control system of the present invention is generally designated 10 and is adapted to control application of liquid adhesive to a plurality of sheets S as they are driven seriatim along a tray 12. Tray 12 may comprise a receiving tray as shown at 108 in the before-mentioned U.S. Pat. No. 4,473,425. Sheets are advanced along tray 12 in the direction indicated by the arrow in FIG. 1 by rollers 14 or other suitable drive means. In this manner the sheets are driven past an adhesive applicator generally designated 16 and described in more detail later. The pneumatic control system of the invention senses the presence of a sheet S in tray 12 and turns the applicator 16 on and off at the appropriate times. For example, the applicator can dispense adhesive from a time just before the sheet reaches the applicator until a time just after the sheet passes the applicator to thereby apply a continuous stripe of adhesive to the upper surface of the sheet as it moves along the tray surface.

Control system 10 comprises a pneumatic proximity switch 20 located in tray 12 in spaced relation to applicator 16 and along the path taken by sheet S as it is driven toward the applicator. The proximity switch 20 comprises an inlet port 22 that is adapted to receive air under pressure from a conduit 24. Air entering port 22 can, for example, have a pressure of about 4 psi. Inlet port 22 communicates through the switch 20 with an outlet port 26 that opens to the upper surface of tray 12 so that air can travel from inlet port 22 through the switch and be discharged through outlet port 26. A restriction 27 in port 26 creates a venturi at the port. A control port 28 also communicates with outlet port 26. In the absence of a sheet S in tray 12, the air entering port 22 is simply discharged to the atmosphere through port 26. However, when a sheet S is present above port 26 of the switch 20 as shown in FIG. 1, a back pressure is created at control port 28 of the switch. This back pressure is created because air entering the inlet port 22 cannot readily escape to the atmosphere through outlet port 26 when a sheet covers port 26.

Figure 2:
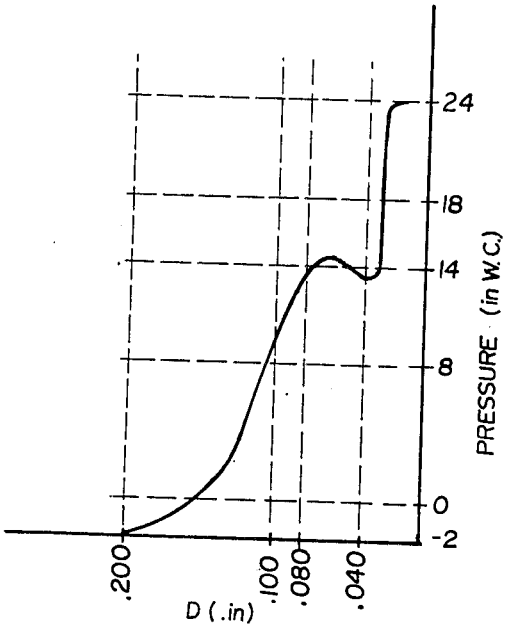
FIG. 2 is a graph illustrating the relationship between the back pressure at the proximity switch and the distance between the switch and a sheet over the switch.

The outlet port 28 is connected to a conduit 30. The air pressure in conduit 30 and outlet port 28 is a function of the presence or absence of a sheet S above the outlet port 26 of the proximity switch. Such pressure is also a function of the distance D between port 26 of the proximity switch and the lower surface of sheet S. This relationship is depicted graphically in FIG. 2. When distance D exceeds about 0.150 inches, there is a negative pressure in port 28 and conduit 30. This results from air under pressure entering port 22 and being exhausted through outlet port 26. At distances D less than about 0.150 inches, air under pressure at outlet port 26 creates a back pressure in port 28 and conduit 30 that rises to about 8 inches of water column when D is approximately 0.100 inches. The pressure remains at values in excess of 8 inches when the sheet is less than 0.100 inches from the proximity switch. Thus there is sufficient pressure at port 28 and in conduit 30 to control other apparatus as explained later.

A pneumatically operated electrical switch 32 has an inlet port in communication with the conduit 30. Switch 32 is connected to a logic and control unit (LCU) 34 which may comprise the logic and control unit for binding apparatus as disclosed in the before-mentioned U.S. Pat. No. 4,473,425. As known in the art, the logic and control unit includes a clock for timing various functions of the apparatus. When pressure in conduit 30 increases above a predetermined value, for example, about 3 psi, switch 32 is closed to provide a signal to the logic and control unit 34 of the apparatus. When pressure in conduit 30 drops below a predetermined value, switch 32 is opened again. Thus the signals provided to the logic and control unit from switch 32 indicate the presence or absence of a sheet above the proximity switch. This allows the logic and control unit to determine that sheets are being received on tray 12 and properly fed along the sheet path leading to the adhesive applicator 16. The logic and control unit times signals coming from switch 32 and can determine on the basis of such timing if the proximity switch is remaining covered for an excessive period of time, which might indicate a misfeed of sheets, for example. The LCU can then signal the machine operator to check for sheet jams.

Conduit 30 also is connected to a two-way electrical control valve 36. Valve 36 is connected to LCU 34 as indicated in FIG. 1. Valve 36 is normally closed and is opened in response to a signal received from the LCU when the operator starts operation of the control system of the invention or the related binding apparatus. As explained in more detail later, valve 36 must be opened before adhesive can be delivered from applicator 16. Therefore, until valve 36 is opened by the LCU, the applicator will not be operated even though a sheet or some other article is placed over the port 26 of the proximity switch.

A conduit 38 is connected to the output port of valve 36 and to the control port 40 of a pressure amplifier 42. Thus the inlet port 40 is coupled to the control port 28 of the proximity switch through valve 36 when the valve is opened by the logic and control unit. Amplifier 42 has an inlet port 44 that is connected by a conduit 46 to a source of air under relatively high pressure, for example, about 20 psi. Amplifier 42 is effective to provide such high pressure air at an outlet port 48 and thus to a conduit 50. Amplifier 42 is normally closed to the flow of air from port 44 to port 48. However, in response to a positive air pressure at control port 40, the amplifier 42 is opened to the flow of air under pressure from conduit 46 to conduit 50.

Conduit 50 also is connected to the inlet port of an air pilot 52 used for activating the adhesive applicator 16. Pilot 52 can be of any conventional construction. For example, the pilot can have an air chamber 53 and a diaphragm shown diagrammatically at 54 which is stretched across the chamber to separate the upper and lower portions of the chamber. The diaphragm 54 is deflected downwardly in response to air under pressure being provided to the upper portion of the air chamber 53 through conduit 50.

The pilot 52 is secured to the upper end of applicator 16. A valve actuator 56 in the applicator is urged upwardly to a closed position by a spring 57. The upper end of the actuator projects into the pilot. During downward deflection of the diaphragm 54 in the pilot, the valve actuator 56 in applicator 16 is moved down to thereby open the applicator to the flow of adhesive.

Adhesive is delivered to the applicator through a conduit 58 secured to one side of the applicator. The applicator has a nozzle 60 with a tip end 62 through which adhesive is dispensed onto sheets. An opening 64 in tray 12 immediately beneath the tip end 62 of the applicator allows any excess adhesive dispensed from the applicator when a sheet is not beneath the nozzle to be delivered to a storage container as disclosed in U.S. Pat. No. 4,473,425.

Liquid adhesive under pressure is provided to conduit 58 from a cartridge 66 containing a supply of adhesive 68. Air under pressure is provided to the upper end of cartridge 66 from a compressor 70 through a conduit 72 that leads from the compressor through a cap 74 on the top of cartridge 66. Thus the air space above the level of adhesive 68 in cartridge 66 is pressurized to thereby force adhesive out of a tube 76 that leads from near the bottom of the cartridge through the cap 74 and is connected to the conduit 58.

Amplifier 42 has a bleed valve 55 that communicates with the conduit 50 and air chamber 53 through the amplifier. Preferably the valve is adjustable so that air under pressure in the amplifier can be bled from the amplifier to the atmosphere in a controlled manner. The bleed valve holds pressure in the chamber 53 of the pilot for a short period of time after a sheet passes the proximity switch 20 so that the flow of adhesive from applicator 16 does not stop until after the trailing edge of the sheet passes the nozzle tip end 62. Thus valve 55 provides an adjustable time delay in the control system. The time delay necessary will depend on the rate at which sheets move along the path leading from the proximity switch to the applicator and the distance between the switch 20 and applicators 16 as well as the length of the sheet.

A machine operator initiates operation by providing information to the LCU 34 through an operator control panel (not shown). The LCU provides a signal to valve 36 to open the valve. The valve remains open until the job is complete. Sheets S are delivered seriatim to the receiving tray 12 and advanced in the direction shown by the arrow in FIG. 1 along a path leading past the applicator 16. Such movement of the sheets is described in more detail in the before-mentioned U.S. Pat. Nos. 4,406,247 and 4,473,425.

When no sheet is located above the proximity switch 20, air entering inlet port 22 is discharged through the outlet port 26. In the absence of a sheet, no back pressure and only a small negative pressure exists in control port 28 and conduit 30. When a sheet passes over the outlet port 26 of switch 20, a back pressure is created in outlet port 28 and conduit 30. The increase in pressure in conduit 30 causes pneumatic switch 32 to be actuated, thereby providing a signal to the logic and control unit 34. The LCU then starts a timing function and, if the sheet does not pass the proximity switch within a predetermined time interval, the operator will be signaled to check for a paper jam.

Air under pressure in conduit 30 is provided through valve 36 to conduit 38 and thus to the control port 40 of the pressure amplifier 42. The increase in pressure at control port 40 resulting from a sheet located over switch 20 opens the amplifier 42 to allow air under relatively high pressure to enter port 44 and pass through port 48 into the conduit 50 and then into the pilot 52. The relatively high air pressure in pilot 52 moves diaphragm 54 downwardly, thereby actuating valve operator 56 to allow adhesive 68 under pressure from cartridge 66 to be provided through conduit 58 to the applicator and thus dispensed through the tip end 62 of the applicator nozzle. Switch 20 is located with respect to nozzle 60 so that the flow of adhesive begins at tip end 62 just prior to the time the leading edge of sheet S reaches the applicator.

When the trailing edge of a sheet passes switch 20, there is a pressure drop in conduits 30 and 38. This opens switch 32 and signals the LCU to stop timing for a paper jam. Also, the pressure drop at port 40 closes the amplifier 42. Bleed valve 55 is adjusted so that the flow of adhesive through tip end 62 continues after the trailing edge of the sheet leaves the switch 20 for a time period sufficient to allow the trailing edge of the sheet to pass beneath the nozzle tip end 62. This cycle is repeated for each of a plurality of sheets driven along the path past the switch 20 and applicator 16.

A number of advantages are achieved by the pneumatic adhesive control system of the present invention. First of all, switch 20 is self-cleaning and thus tends to function for a long period of time without requiring service. Secondly, the system works rapidly in response to sensing of the sheet itself and without requiring timing by the logic and control unit as required with prior systems. Also, the system is essentially pneumatically operated and thus not subject to actuation by stray electrical signals. By using a pneumatic proximity switch for detecting a sheet on tray 12, instead of an optical system, several advantages are achieved. More specifically, problems resulting from a dirty optical sensor are avoided, the system does not respond to stray light beams that can operate optical sensors, and the pneumatic system can detect transparent sheets on tray 12. Additionally, use of the pilot 52 to actuate the applicator 16 eliminates the possibility that existed with the prior system of having adhesive bleed past seals and contaminate the electrical coil of the solenoid used to actuate the applicator. The system is capable of very fast response times, for example, on the order of about 5–10 milliseconds. The components of the system are commercially available at a reasonable cost, thereby making the system economical to assemble.

The invention has been described in detail with particular reference to a preferred embodiment thereof, but it will be understood that variations and modifications can be effected within the spirit and scope of the invention.

I claim:

1. A system for applying a stripe of liquid adhesive to a plurality of sheets advanced along a path leading past an adhesive applicator, the system comprising:

a pneumatic proximity switch located along the path adjacent the applicator, the switch having (1) an air inlet port for receiving air under pressure, (2) an air outlet port communicating with the inlet port and located adjacent the path for directing air under pressure from the inlet port into the path and (3) a control port communicating with the outlet port so that when a sheet is in the path over the outlet port a back pressure is created at the control port;

the applicator having (1) a nozzle located above the sheet path through which adhesive is applied to a sheet, (2) an inlet port for receiving liquid adhesive under pressure from an adhesive supply and (3) a pneumatically controlled valve operable when actuated by air under pressure to allow the flow of adhesive from the inlet port to the nozzle and thus to a sheet beneath the nozzle; and a pressure amplifier having an inlet port for receiving air under pressure from a source and an outlet port coupled to the applicator valve, the amplifier having a control port coupled to the control port of the proximity switch, and the amplifier being responsive to an increase in back pressure at the control port of the proximity switch to provide air under pressure from the source to the applicator valve to thereby actuate the valve so that adhesive is applied to a sheet driven along the path and beneath the applicator.

2. A system as set forth in claim 1 further comprising a logic and control unit, a normally closed, electrically operated valve between the control port of the proximity switch and the inlet port of the amplifier, the normally closed valve being operated by the logic and control unit to thereby enable the operation of the amplifier by the proximity switch.

3. A system as set forth in claim 2 further comprising a pneumatically operated electrical switch coupled to the control port of the proximity switch and the logic and control unit for providing an electrical signal to the logic and control unit when a sheet is located over the outlet port of the proximity switch.

4. A pneumatic system for controlling the flow of adhesive from an applicator to a sheet driven along a path leading past the applicator, the system comprising:

a pneumatic proximity switch located along the path for sensing a sheet as it approaches the applicator;

the applicator having an inlet port for receiving adhesive from an adhesive supply and a pneumatically operated valve for controlling the flow of adhesive through the applicator to a sheet;

means responsive to the proximity switch sensing a sheet in the path for actuating the valve in the applicator to thereby apply adhesive to the sheet, the valve actuating means comprising a pressure amplifier for receiving air under pressure and providing such air to the valve, and the amplifier having a control port coupled to the proximity switch so that the amplifier is operated to provide air under pressure to the valve in response to the proximity switch sensing a sheet in the path;

a normally closed electrically operated valve between the control port of the amplifier and the proximity switch; and a logic and control unit for providing a signal to the normally-closed valve to open such valve and enable operation of the amplifier by the proximity switch.

5. A pneumatic system for controlling the flow of adhesive from an applicator to a sheet driven along a path leading past the applicator, the system comprising:

a pneumatic proximity switch located along the path for sensing a sheet as it approaches the applicator;

the applicator having an inlet port for receiving adhesive from an adhesive supply and a pneumatically operated valve for controlling the flow of adhesive through the applicator to a sheet;

means responsive to the proximity switch sensing a sheet in the path for actuating the valve in the applicator to thereby apply adhesive to the sheet;

a normally closed electrically operated valve between the valve actuating means and the proximitiy switch;

a logic and control unit for providing a signal to the mormally-closed valve to open such valve and enable operation of the valve actuating means; and means responsive to the proximity switch sensing a sheet in the path for providing a signal to the logic and control unit.

* * * * *